US007284682B2

(12) United States Patent
Zorzo

(10) Patent No.: US 7,284,682 B2
(45) Date of Patent: Oct. 23, 2007

(54) BOTTLE FOR LIQUIDS AVAILABLE ON THE MARKET FITTED WITH A DEVICE SO THAT IT WORKS LIKE A QUICK-FIT/QUICK-RELEASE TANK TO/FROM A SUITABLE SUPPORT EQUIPPED WITH A DRAIN

(75) Inventor: Bruno Zorzo, Villa Del Conte (IT)

(73) Assignee: Filmop s.r.l., Villa del Conte (PD) (IT)

( * ) Notice: Subject to any disclaimer, the term of this patent is extended or adjusted under 35 U.S.C. 154(b) by 265 days.

(21) Appl. No.: 11/141,872

(22) Filed: Jun. 1, 2005

(65) Prior Publication Data

US 2006/0027601 A1 Feb. 9, 2006

(30) Foreign Application Priority Data

Aug. 6, 2004 (IT) ..... PD2004A0145

(51) Int. Cl.
*B67D 5/06* (2006.01)
*B67D 3/00* (2006.01)

(52) U.S. Cl. ..... 222/184; 222/185.1; 222/481.5; 222/518; 222/568

(58) Field of Classification Search ..... 222/80, 222/185.1, 481.5, 518, 545, 546, 568, 571, 222/184

See application file for complete search history.

(56) References Cited

U.S. PATENT DOCUMENTS

| | | | | |
|---|---|---|---|---|
| 3,288,332 | A * | 11/1966 | Etter et al. | 222/80 |
| 3,814,293 | A * | 6/1974 | Daves | 222/173 |
| 4,281,779 | A * | 8/1981 | Shepard | 222/501 |
| 5,964,376 | A * | 10/1999 | Kenosha | 222/1 |
| 6,131,774 | A * | 10/2000 | Thomas et al. | 222/181.2 |
| 6,527,145 | B1 * | 3/2003 | Bennett, Jr. | 222/185.1 |
| 6,533,145 | B2 * | 3/2003 | Lewis et al. | 222/181.3 |
| 6,892,903 | B1 * | 5/2005 | Bartolotta | 222/185.1 |
| 6,923,345 | B1 * | 8/2005 | Laible | 222/185.1 |

* cited by examiner

*Primary Examiner*—Joseph A. Kaufman
(74) *Attorney, Agent, or Firm*—Thomas S. Baker, Jr.

(57) ABSTRACT

It is a liquid-containing bottle (1) available on the market that is fitted with device (7, 8, 9) that applied instead of the original plug allows its quick-fitting and -dismantling to/from a suitable support (18, 19, 21) equipped with drain (16, 17) using the liquid without any spillage, and fitted with a cap (12) applied to the bottom (3, 4) equipped with a manual valve (13, 14) to put its inside into communication with the atmosphere.

4 Claims, 8 Drawing Sheets

BOTTLE FOR LIQUIDS AVAILABLE ON THE MARKET FITTED WITH A DEVICE SO THAT IT WORKS LIKE A QUICK-FIT/QUICK-RELEASE TANK TO/FROM A SUITABLE SUPPORT EQUIPPED WITH A DRAIN

CROSS-REFERENCES

None.

BACKGROUND OF THE INVENTION

1. Field of the Invention

The subject o this invention is the application of a device to a standard liquid-containing bottle available on the market so that it takes the shape of a liquid-containing tank of the quick-fit/quick-release type with its relative support connected to a drain.

Said device is applied to the bottle instead of its normal plug.

The bottle filled with liquid and equipped with this device can easily be positioned on its support in communication with the drain and can be easily removed from its support, even if it is still full of liquid, without any spillage because the outlet is blocked by the foot valve the device is provided with.

2. Technical Details

This patent concerns in particular the field of sweeping and floor-treatment brushes where their handles are fitted with liquid-containing tanks (detergents, disinfectants, etc.) to apply to the floor.

The sweeping brushes fitted with fixed tanks in their handles where the liquid must be poured into the tank and the brushes fitted with tanks that, even if filled with liquid, can be inserted and removed without any spillage from a support provided with a discharge fixed onto the handles, are well known.

It is well known that said receptacles are fitted with sealing foot valves that are opened only once they are positioned correctly on their supports.

Normally, the filling of said movable tanks takes place when they are not fitted onto their supports and therefore there numerous tanks can be available for different liquids.

For both removable and non removable tanks, the liquid must be transferred from the bottle into the tanks. There is on the market a sweeping brush that can take standard liquid bottles so that the liquid can be used directly without requiring any transfer.

The problems with the sweeping brushes where handles are fitted with a support provided with a draining tap and an element opposite the support that pushes the bottle against the support itself arise from the fact that, to fit the bottle, the brush needs to be turned upside down, to be turned back to its original position once the bottle is fitted.

The comparison between the advantage of using the liquid directly from the bottle and the inconvenience of having to turn the brush upside down twice whenever a bottle needs to be fitted or removed caused this method to be abandoned.

SUMMARY OF THE INVENTION

The purpose of this patent is the possibility of using liquids directly from the standard bottles available on the market without having to turn the brush upside down twice and of fitting and removing the bottles quickly without any spillage to and from a suitable support fixed to the handle, using the same principle as the quick-fit/quick-release tanks available on the market.

Because of its simplicity and practicality, this patent is very innovative and useful and revolutionises all that has been achieved on the field up till now.

It means that a standard bottle available on the market is filled with liquid and its plug is substituted with a plug equipped with a sealing valve so that the bottle can be turned upside down without any spillage.

If the external configuration of the valve plug that is applied to the bottle is made as a complement to the support fitted to the brush handle, said plug can be fitted into the support and, once the connection is completed, the valve is opened and the liquid inside the bottle can flow through the drain connected to the support.

In order to avoid depression in the bottle during the liquid transfer, once the new plug provided with valve is fitted onto the bottle and this is turned upside down, a small hole is made in its bottom putting the inside of the bottle in communication with the atmosphere.

To maintain or stop said communication between the inside of the bottle and the atmosphere through the hole pierced on its bottom, a cap is applied to said bottom whose skirt seals a side portion adjoining the bottom of the bottle and which is operated by a manual valve the cap is fitted with.

The hole on the bottom of the bottle can be made with the cap fitted by providing the lower part of the movable element in the manual valve with a punch that can be metal.

When this mobile element in the valve lowers, the punch pierces the bottom wall and stays in the hole. By lifting this movable element of the valve, the punch comes out of the hole and the inside of the bottle is put into communication with the atmosphere. Fitted with the above-described devices, that is a substitute plug equipped with a foot valve and a cap equipped with a manual valve, the bottle has the same functional characteristics as the movable tanks available on the market for their quick-fit/quick-release from their supports without any spillage.

The examination of the attached drawings clarifies this description.

The sealing quality of this device is ensured thanks to a suitable spring operated valve.

Said device has the shape of a glass on the plug side in order to enclose the top part of the bottle body and on the opposite side it is shaped as a skirt in order for it to be inserted into its drain-fitted support.

Figure 4:
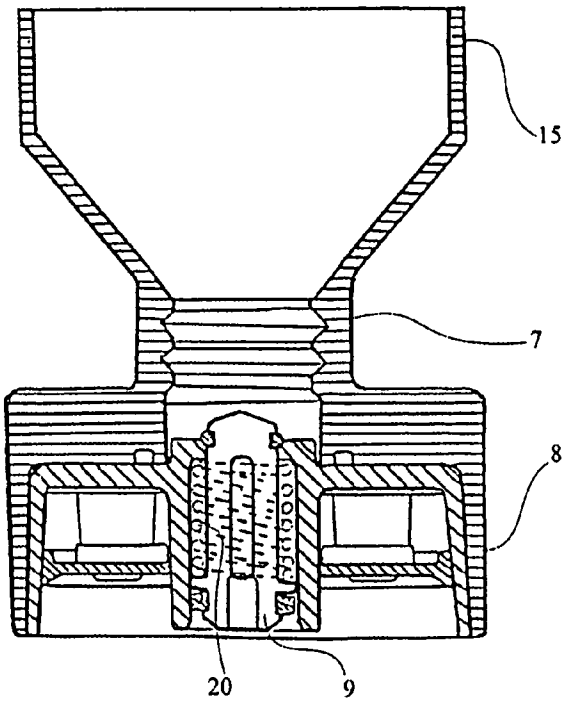
Figure 3:
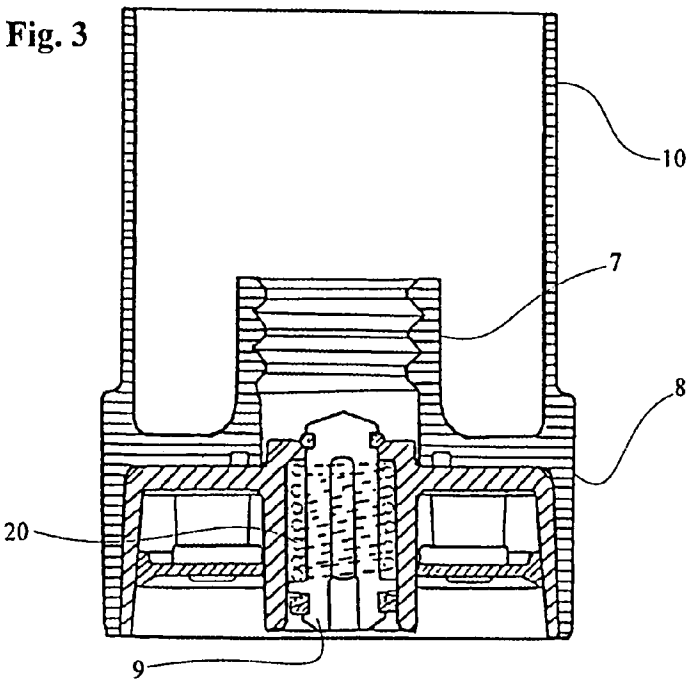
FIG. 3 is a sectional view of the device comprising of an element configured as a plug, with an internal thread matching the external thread on the bottle neck, that is applied to the bottle instead of the commercial plug.

FIG. 4 is a sectional view of the device applied to the bottle instead of its top, functionally identical to the plug in FIG. 3 with the only difference that on the plug's side the glass is shaped in such a way as to enclose both the top part of the bottle body and the funnel-shaped part joining the bottle body to its neck.

Figure 2:
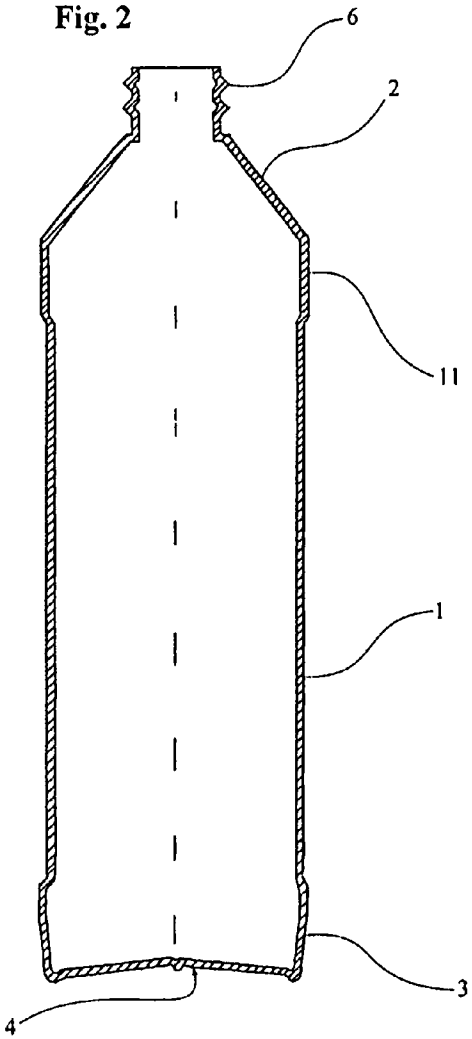
FIG. 2 shows the same bottle as FIG. 1 in section, without plug.
Figure 1:
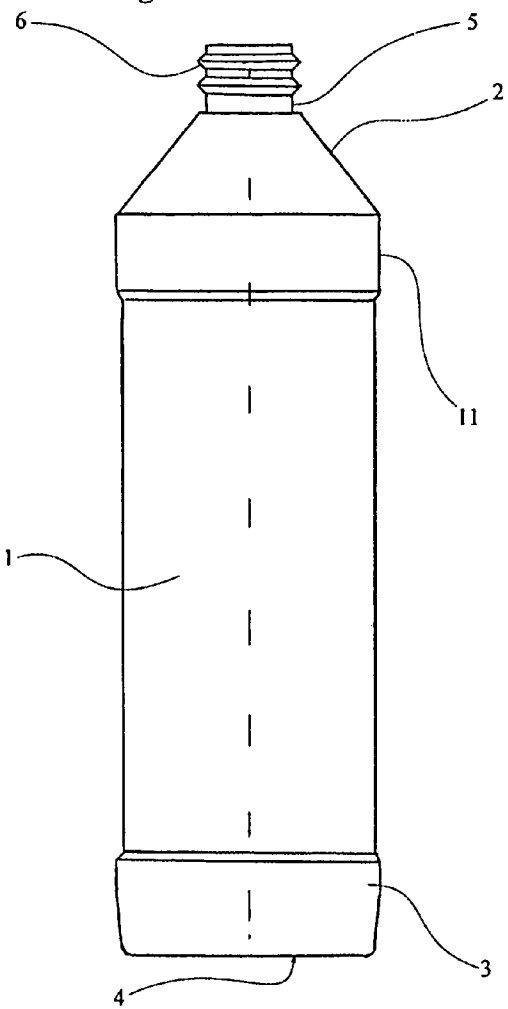
FIG. 1 shows a standard bottle for cleaning and floor-treating liquids available on the market, that can be made of a resinous material, whose body ends with a narrow neck provided with a thread on the outside for a screwing down plug (the plug is not shown).
Figure 5:
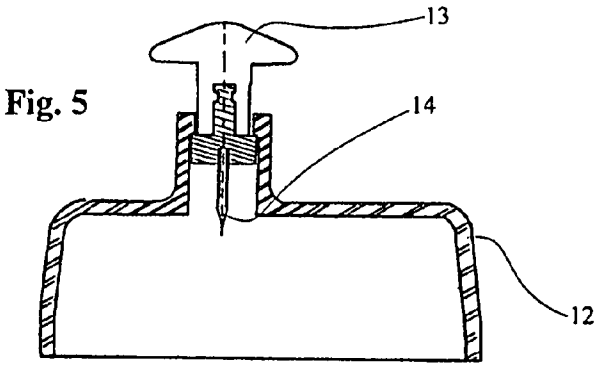

FIG. 5 is a sectional view of the cap that can be applied to the bottom of the bottle body: fitted with a manual valve, this cap allows and prevents the communication between the inside of the bottle and the atmosphere provided a hole is made on the bottom of the bottle.

The movable element in the manual valve that in the drawing is shown lifted off its seat, when pressed, can make the hole on the bottom of the bottle.

Figure 6:
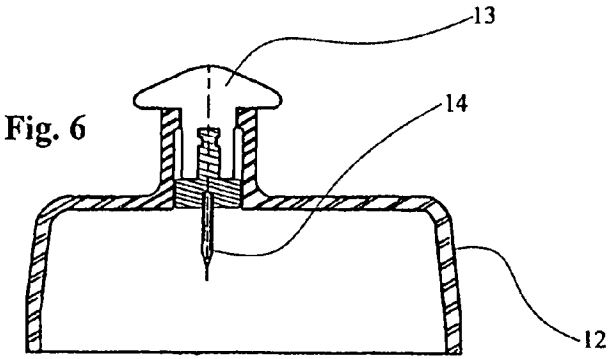

FIG. 6 is a sectional view of the same cap as in FIG. 5 but the movable element of the manual valve is lowered totally onto its seat.

Figure 7:
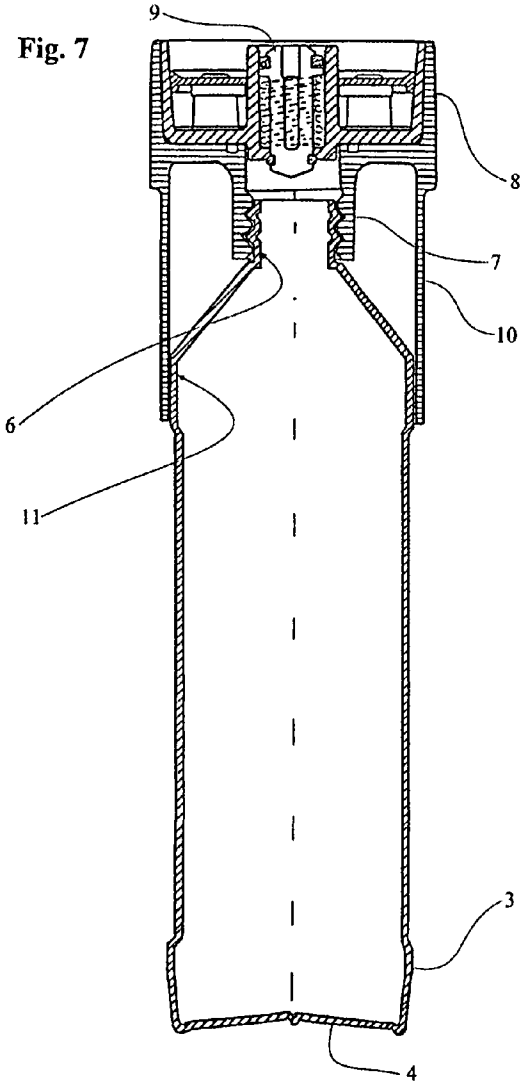

FIG. 7 is a sectional view of a liquid-containing bottle available on the market whose top has been substituted with the device that is the subject of this patent comprising of a plug fitted with a valve that is kept closed by the action of a spring.

The device is shaped as a glass enclosing the top part of the bottle body giving the assembly solidity.

Figure 8:
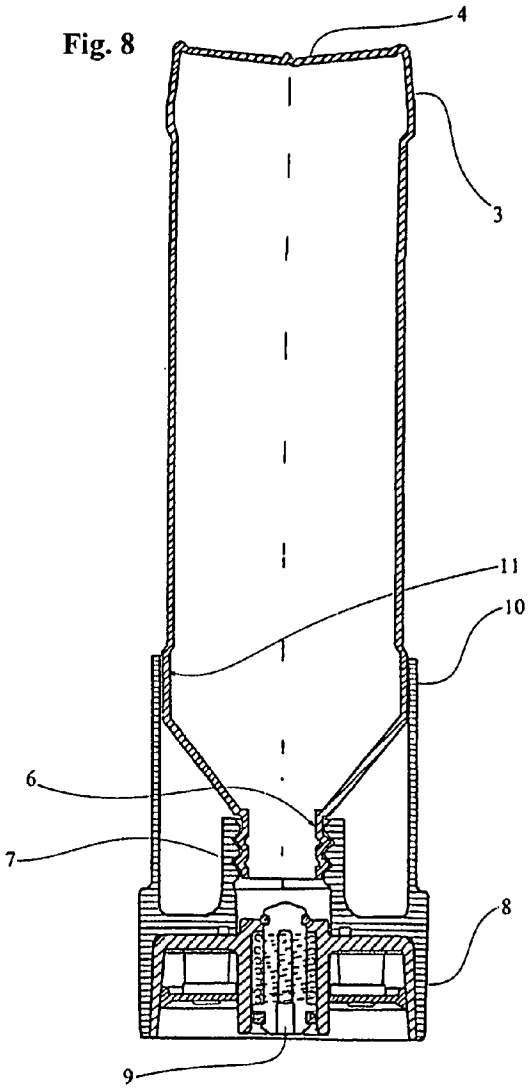

FIG. 8 shows the same bottle as FIG. 7 but turned upside down.

The liquid cannot escape thanks to the seal of the valve the device is fitted with.

The skirt of the device that is to be inserted into the liquid-draining support is a suitable standing base when the overturned bottle and device are not in use.

Figure 9:
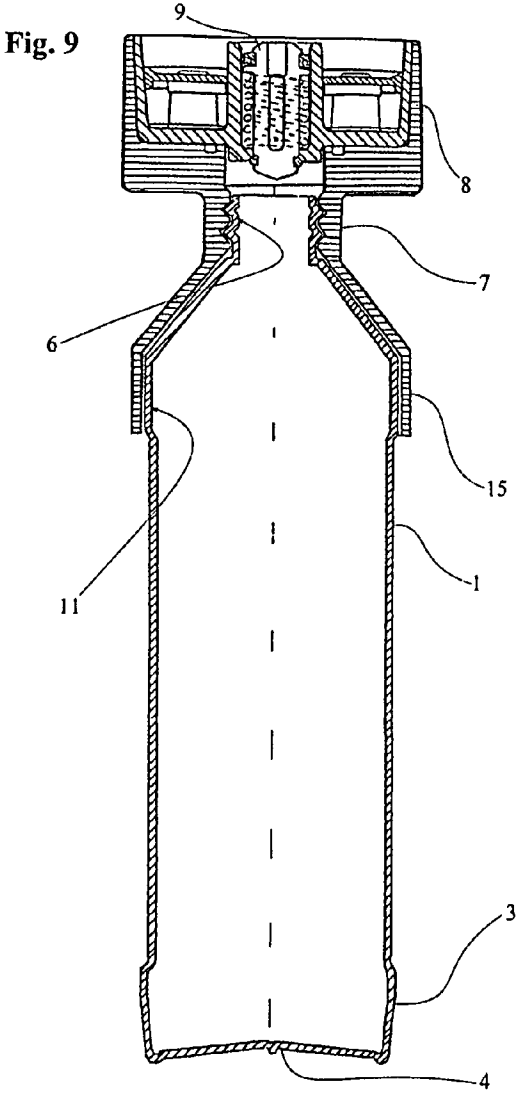

FIG. 9 shows the same glass as FIG. 7 that is the subject of this patent but this time rather than being totally cylindrical it is shaped like a goblet so as to fit the shape of the top part of the bottle that it encloses.

Figure 10:
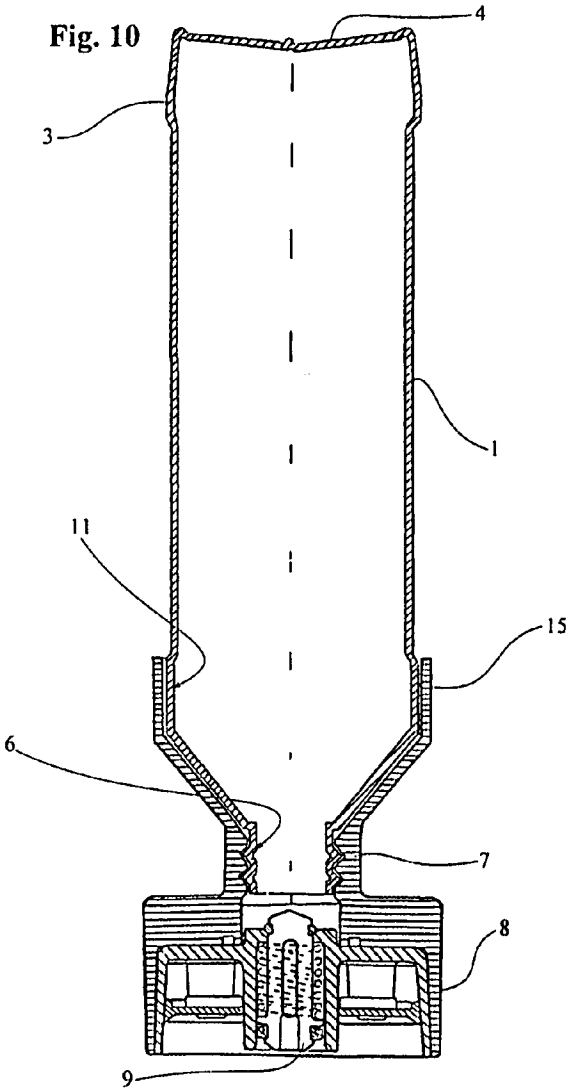

FIG. 10 corresponds to FIG. 8 with the same functions, where the skirt of the device is the standing base for the assembly with the overturned bottle.

Figure 11:
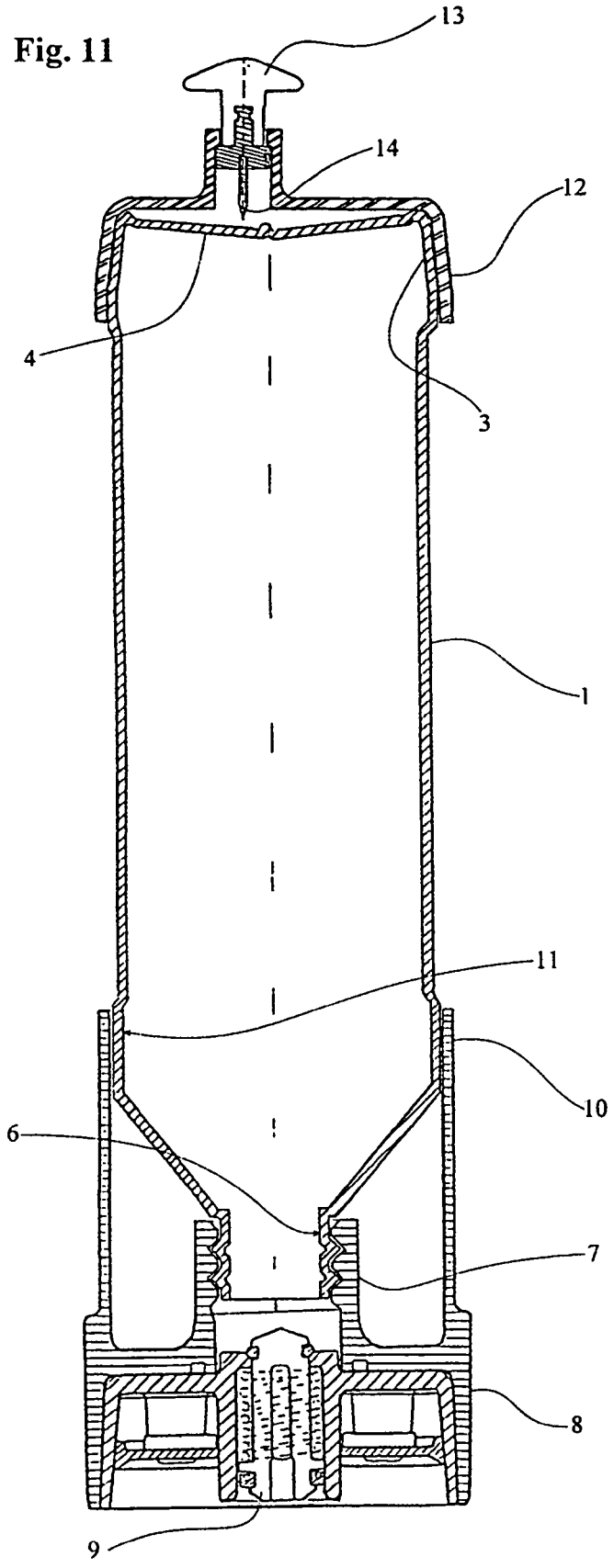

FIG. 11 corresponds to FIG. 8 and shows an overturned bottle not in use fitted with plug device that is the subject of this patent whose skirt is the standing base where the lower part of the bottle in a standing position is covered with a cap that seals it.

The cap is equipped with a manual valve whose raised movable element does not affect the bottom wall with its punch.

Without a hole on the bottom wall the inside of the bottle cannot be in communication with the atmosphere.

Figure 12:
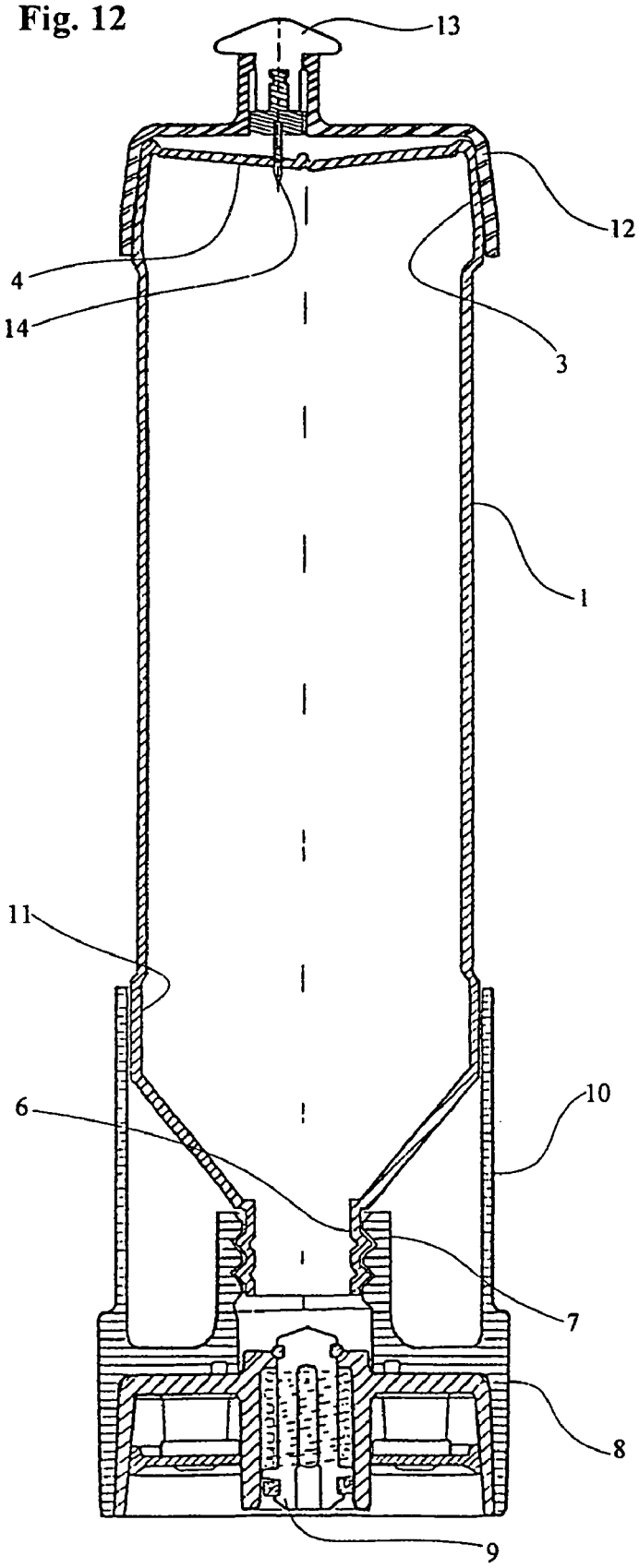

FIG. 12 is the corresponding representation of FIG. 11 where the punch of the movable element of the manual valve is now lowered and has pierced the bottom wall of the bottle.

In this position, because of both the punch that fills the hole on the bottom wall of the bottle and the position of the movable element of the valve that is lowered in a closed position, the inside of the bottle is not in communication with the atmosphere and the liquid inside the bottle cannot flow freely even if the bottle is upside down and the valve is open.

Figure 13:
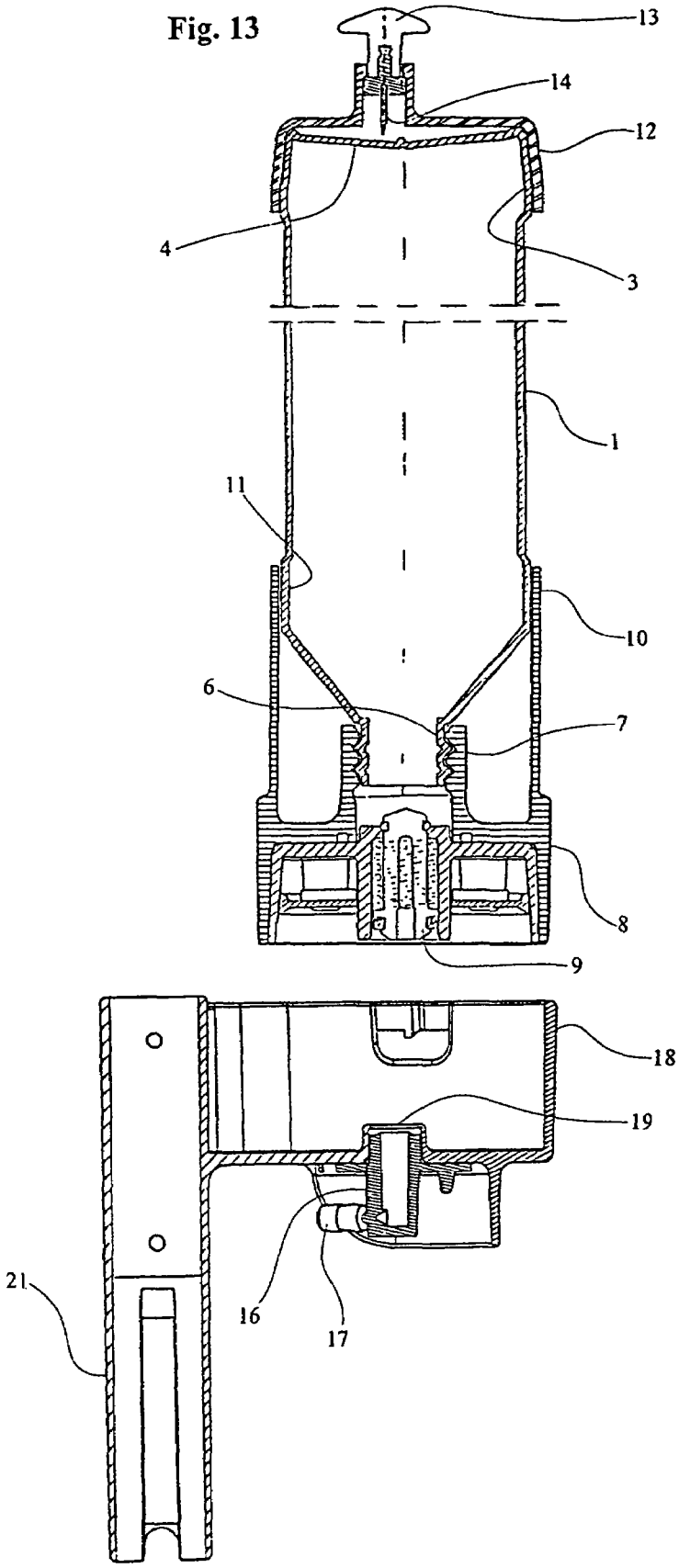

FIG. 13 shows the group made up of the bottle and device with a foot valve and cap equipped with a manual valve as seen in FIG. 11 together with the cup of the support that is provided with a support for applying the brush handle.

Once the handle is inserted into the support cup the foot valve in the device is lifted and the liquid in the bottle can flow through the open drain regularly provided the bottom of the bottle has been pierced and the manual valve of the cap is open.

Figure 14:
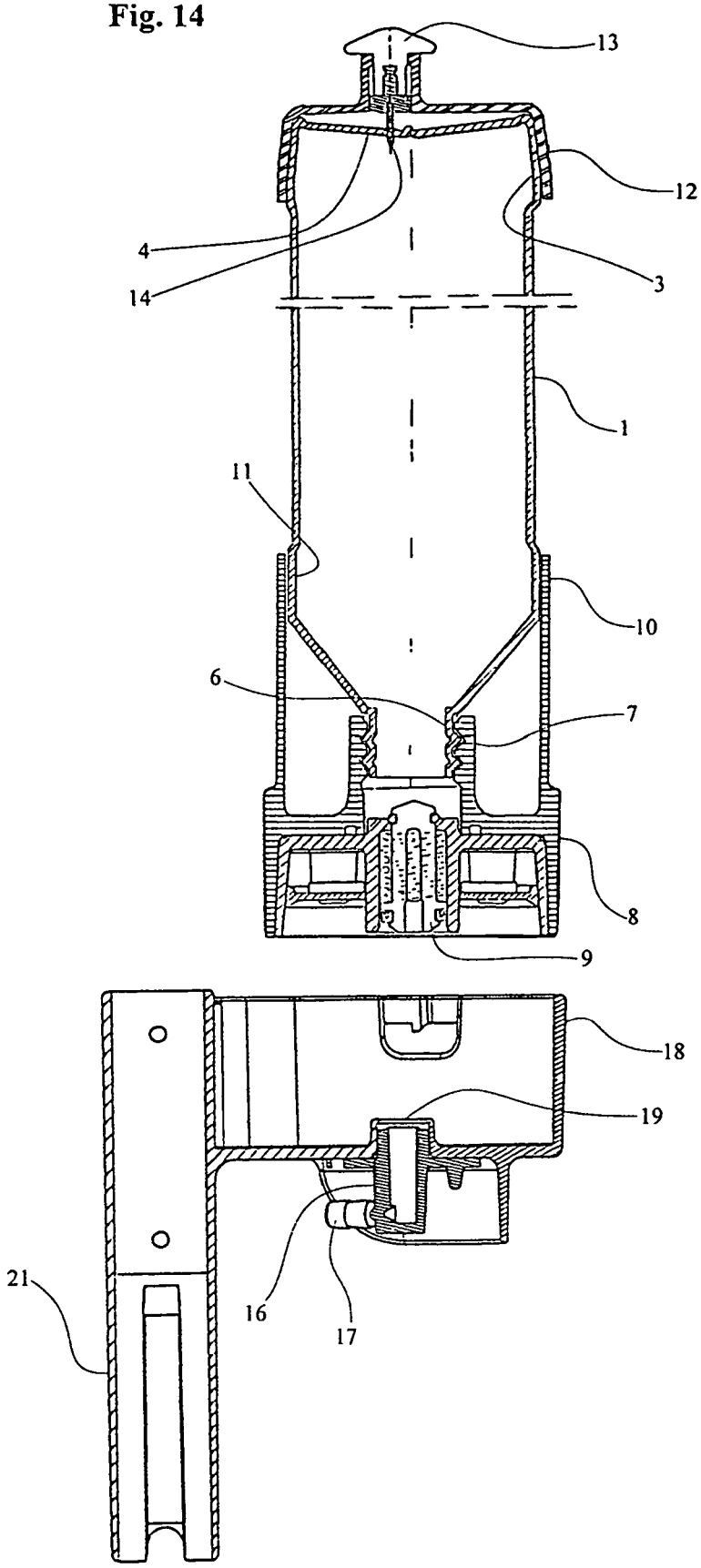

FIG. 14 is the same as FIG. 13 with the only difference that the punch of the movable element in the manual valve is inserted into the hole in the bottom wall of the bottle and the manual valve is closed.

DETAILED DESCRIPTION

For the practical use of the device that is the subject of this patent it is necessary to proceed as follows.

It must be stated beforehand that for the device that is the subject of this patent to be applied, the liquid-containing bottle can be a standard bottle available on the market whose body measurements and neck diameter with its relative unified thread match the measurements and the configuration of the plug of a pre-defined device, or the bottle must be specially made matching the device it will be coupled with. Otherwise the plug device that is the subject of this patent must be made to match the bottle used. In any case the device to be applied to the bottle by changing its top so that it can be used as a tank equipped with a foot valve for the quick-fit/quick-release from its support provided with a drain, must match the bottle.

Bottle 1 must therefore be taken and its top (not shown) removed, screwing device 7 is then applied screwing it down on thread 6 of neck 5.

Device 7 is equipped on the side of plug 7 with glass 10, 15 encloses top part 11, 2 of bottle 1 keeping it in position.

The sealing quality of plug 7 is ensured by foot valve 9 that is kept closed by spring 20. Bottle 1, fitted with device 7, 10, 15 can be turned upside down and stands straight thanks to skirt 8 of device 7, also because it is inserted into cup 18 of the support which is a good standing base.

Bottle 1, fitted with device 7, is inserted into drain-fitted support 16, 17 inserting skirt 8 into device 7 in cup 18 of the support applied to the handle of a sweeping brush (not shown) by means of tube 21. Once skirt 8 is inserted into cup 18, prominence 19 on the bottom of cup 18 engages valve 9 and, in opposition to valve 20, lifts it putting the inside of bottle 1 in communication with drain 16, 17.

So that depression within the bottle does not block the transfer of the liquid, the inside of the bottle is put into communication with the atmosphere by making a hole on the bottom wall of said bottle.

With the aim of achieving the same function as the quick-fit/quick-release tanks with supports and drains, cap 12 fitted with manual valve 13 is applied to bottom 4 of bottle 1 that is equipped with screwing device 7 with foot valve 9. Said cap 12, that, applied to the bottle, seals band 3 of bottle 1 that is adjoining bottom 4, is equipped with manual valve 13, whose movable element is fitted below with punch 14 that can pierce bottom wall 4, and behaves like the plug fitted with a manual valve of the above-mentioned quick-fit/quick-release tanks with support and drain available on the market.

The above description shows how new and innovative the patent is since it allows to fit standard liquid-containing bottles available on the market with devices so that they can be used without any need for the liquid to be transferred, fulfilling the same function and being just as practical as the quick-fit/quick-release tanks with supports and drains fixed to the sweeping brushes available on the market.

The patent covers any improvements that experts in the field might bring in by using the principles of this patent.

The invention claimed is:

1. Bottle for liquids available on the market fitted with a device so that it works like a quick-fit/quick-release tank to/from a suitable support fitted with an outlet, where said device (7), replacing the original plug, is equipped with a valve (9) for releasing the liquid inside the bottle (1) characterised by the fact that said device (7) is equipped with a skirt structure that constitutes the standing base for the assembly, overturned bottle (1) and device (7), when not in use, keeping the bottle (1) in an upright position, and by the fact that said skirt (8), when inserted in support cup (18) fitted with an outlet (16, 17), permits the centering of the coupling, when the bottle (1), equipped with said device (7) on the special cup (18), is inserted between said valve (9) with a prominence (19) on said special cup (18).

2. Bottle for liquids available on the market fitted with a device so that it works like a quick-fit/quick-release tank to/from a suitable support equipped with a drain as per claim 1 characterised by the fact that device (7) fitted to bottle (1) in substitution for original plug (6) includes from the opposite side of skirt (8) a glass (10, 15) that encloses and keeps the upper part (11, 2) of bottle (1) in position.

3. Bottle for liquids available on the market fitted with a device so that it works like a quick-fit/quick-release tank to/from a suitable support equipped with a drain as per claim 1 characterised by the fact that the bottle is not only fitted with plug (7) but also with cap (12) on bottom (4) which seals belt (3) adjoining bottom (4) and this cap (12) equipped with manual valve (13) either puts the inside of the bottle into communication with the atmosphere or prevents it provided a hole is pierced on bottom wall (3).

4. Bottle for liquids available on the market fitted with a device so that it works like a quick-fit/quick-release tank to/from an appropriate support fitted with an outlet according to claim 3 characterised by the fact that the nail (14) placed further down and integral to the hand valve (13), put in cap (12) that it encircles holding the band (3) contiguous to the bottom (4) of the bottle (1), guarantees, together with the valve (13) itself, when it is placed within the hole, the holding of the bottle (1) preventing communication of the atmospheric air with the inside of the bottle (1).

* * * * *